US005649808A

United States Patent [19]

Gruszecki et al.

[11] Patent Number: 5,649,808

[45] Date of Patent: Jul. 22, 1997

[54] MOTOR PASSIVE DIRECTION INDICATOR AND REVERSAL ALARM

[75] Inventors: Gary A. Gruszecki, Arvada; Jon Steven Ingebrigtsen, Lakewood; Bruce S. Ellingboe, Littleton, all of Colo.

[73] Assignee: COBE Laboratories, Inc., Lakewood, Colo.

[21] Appl. No.: 472,938

[22] Filed: Jun. 6, 1995

[51] Int. Cl.[6] ..... F04B 49/10

[52] U.S. Cl. ..... 417/63; 417/374; 417/477.1

[58] Field of Search ..... 417/63, 239, 374, 417/477.1, 477.2, 477.3, 477.4, 477.5, 477.6, 477.7, 477.8, 477.9, 477.11, 477.12, 477.13, 477.14

[56] References Cited

U.S. PATENT DOCUMENTS

| | | | |
|---|---|---|---|
| 3,700,361 | 10/1972 | De Vries | 417/477.8 |
| 3,963,023 | 6/1976 | Hankinson | 417/477.11 |
| 4,108,575 | 8/1978 | Schal | 417/477.7 |
| 4,573,884 | 3/1986 | Troutner | 417/477.7 |

FOREIGN PATENT DOCUMENTS

| | | | |
|---|---|---|---|
| 2758745 | 7/1979 | Germany | 417/374 |

OTHER PUBLICATIONS

Excerpt of ITT Schadow Inc. 1992–1993 Catalog, p. 85.

*Primary Examiner*—Timothy Thorpe
*Assistant Examiner*—Roland G. McAndrews, Jr.
*Attorney, Agent, or Firm*—Bruce R. Winsor; Edna M. O'Connor

[57] ABSTRACT

A method and apparatus for preventing accidental manual rotor reversal in a peristaltic pump is provided. A peristaltic pump may be provided with a hand crank or the like to drive a rotor assembly of the pump manually in the event of failure of the electric motor drive of the pump. An indicator may provide information to the pump operator to inform the operator of the direction in which the pump was rotating when last driven by the electric motor. Further an alarm device may alert the operator when the operator is attempting to rotate the pump in the direction opposite the direction in which the pump was rotating when last driven by the electric motor or the direction last selected by the operator before loss of power.

25 Claims, 12 Drawing Sheets

FIG. 6

159

| 28 CONDITION | A A | B B | 134 U1 | 148 U3A | 152 U3B | 146 U2A | 156 U2B | U2C | 62 ALARM |
|---|---|---|---|---|---|---|---|---|---|
| STATIONARY | HI | HI | HI | LO | HI | LO | HI | HI | OFF |
| STATIONARY | HI | HI | LO | HI | LO | LO | HI | HI | OFF |
| CW-CORRECT | HI | LO | HI | LO | LO | HI | HI | HI | OFF |
| CW-WRONG | HI | LO | LO | HI | HI | HI | LO | LO | ON |
| CCW-CORRECT | LO | HI | LO | LO | LO | HI | HI | HI | OFF |
| CCW-WRONG | LO | HI | HI | HI | HI | HI | LO | LO | ON |

HI = HIGH LOGICAL STATE
LO = LOW LOGICAL STATE

MOTOR PASSIVE DIRECTION INDICATOR AND REVERSAL ALARM

FIELD OF INVENTION

The present invention relates to direction indicators and reversal alarms for electric motors. More particularly, the present invention relates to a passive direction indicator and reversal alarm for reducing the probability of manual rotor reversal that may occur when motor driven peristaltic pump rotors are unable to continue pumping and must be manually rotated.

BACKGROUND OF THE INVENTION

Peristaltic pumps are used in many medical and surgical procedures to circulate a patient's blood and are typically driven by electric motors. During some of these procedures, it is important that blood circulation remain substantially constant and uninterrupted. This is particularly true during cardiovascular surgery when a pump may be substituting for a patient's heart and may be circulating blood through a device which substitutes for the patient's lungs. Substantial interruption in such a case may result in injury, possibly including severe injury or death.

In cardiovascular surgery a patient's heart is often stopped and a bypass circuit provided comprising peristaltic pumps, reservoirs and oxygenators which bypass the patient's heart and lungs. Oxygen-poor or venous blood, is removed from the patient's circulatory system, passed through an oxygenator to oxygenate the blood, and returned to the patient's circulatory system to perfuse the patient with oxygenated, or arterial, blood.

Peristaltic pumps may become inoperative for a variety of reasons. For example, peristaltic pumps may lose power or fail due to any one of a number of well-known mechanical or electrical causes. Peristaltic pumps for use in cardiovascular surgery are typically provided with a hand cranking device. In the event that a pump becomes unable to continue pumping during a medical procedure for any reason, the pump rotor is turned by hand until a back-up pump is positioned. Where no back-up pump is available the pump rotor must be turned by hand for the duration of the medical procedure.

A serious problem in prior art pumps stems from the fact that peristaltic pump rotors may be rotated in either the clockwise or counterclockwise direction. Although relatively rare, cases have been reported where, in the transition from power to hand rotation, a pump user ("perfusionist") has rotated the pump rotor backwards. In other words, where a pump rotor was rotating in a clockwise direction before it became inoperative, the pump user manually rotated it in a counterclockwise direction or vice versa. Reversing the direction of the rotor rotation, correspondingly reverses the direction of blood circulation which can pull air into the peristaltic pump tubing. The perfusionist subsequently rotated the pump rotor in the forward direction; thus, injecting the air into the patient's circulatory system. Further, if reverse rotation is maintained, the patient may not be adequately perfused with oxygenated blood. Injecting air into a patient's circulatory system can result in severe injury or death. Further, these events can occur during times when other equipment is failing, further increasing the possibility, however remote, that the perfusionist may inadvertently turn the pump the wrong way.

Prior art pumps do not have the ability to detect rotor rotation reversal when the pump is not powered. Nor are prior art pumps designed to clearly and reliably indicate at a convenient location, when the pump power is off, the last rotation direction in which the rotor was travelling when the pump was operational. Some prior art pumps do have a manual reversing switch with labeled switch positions, but this switch's position can be changed by the perfusionist when power is off, so that it does not provide reliable indication of the last rotation direction. A perfusionist, therefore, generally must rely on memory and does not have a clear visual system when the pump is inoperational to help determine in which direction the pump rotor should be manually rotated to maintain adequate perfusion.

SUMMARY OF THE INVENTION

A significant aspect of the present invention is a system for preventing the inadvertent manual reversal of a peristaltic pump's rotor rotation direction during a medical procedure. In accordance with this aspect of the invention, the invention uses a controller to run the peristaltic pump. The controller comprises a circuit that detects the direction in which the peristaltic pump rotor is travelling. Alternatively, the controller circuit may detect a direction that a perfusionist selected for the peristaltic pump rotor to rotate. The controller then sets a direction indicator to reflect the direction in which the pump rotor is turning or the direction selected by the perfusionist. In the event of a system failure, the direction indicator continues to display the last detected direction in which the pump rotor was turning. Where the controller circuit detects a direction selected by the perfusionist, the direction indicator continues to display the last intended direction in the event of a system failure. A system failure is herein defined as the loss of pump power for any reason. A pump user may then manually rotate the pump rotor in the correct direction as displayed by the direction indicator.

The direction indicator may maintain its display of the last detected rotor direction by connecting the direction display to a non-returning actuator. A non-returning actuator is a device that does not change position when the power that was driving it fails. Alternatively, the direction indicator may be a powered display having an independent power source, such as a battery or capacitor.

In another significant aspect of the present invention, if the pump rotor is manually reversed despite the direction indicator, the present invention will sound an alarm, giving a pump user time to correct the rotation direction before air is pulled into the tubing or to prime the line. The alarm comprises a circuit designed to detect unintended pump rotor reversals, even in the event of a system failure. Accordingly, the circuit and alarm may be energized by an independent power source or by the electromotive force generated by manually rotating the pump rotor.

Another important aspect of this invention is a mechanism for checking the accuracy of the direction indicator. In accordance with this aspect of the invention position sensors are located in the peristaltic pump housing to detect the direction indicator position. The sensors report the direction indicator position to the controller. The controller correlates the reported direction indicator position with the actual rotor rotation direction and sounds an alarm if an error is found.

Another important aspect of this invention is to provide a direction indicator that is visible in the dark. In accordance with this aspect of the invention, the direction indicator may comprise a phosphorescent symbol. Alternatively, the powered display may comprise a light.

Another important aspect of this invention is to provide a circuit for the rotor reversal alarm that engages automatically when the pump power is off or the controller is reset.

Another important aspect of this invention is to provide a rotor reversal alarm that only sounds when the rotor reversal is unintentional.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 6 is a logic truth table illustrating the functions of the electrical circuit of FIG. 5.

DETAILED DESCRIPTION OF THE PREFERRED EMBODIMENTS

Figure 1:
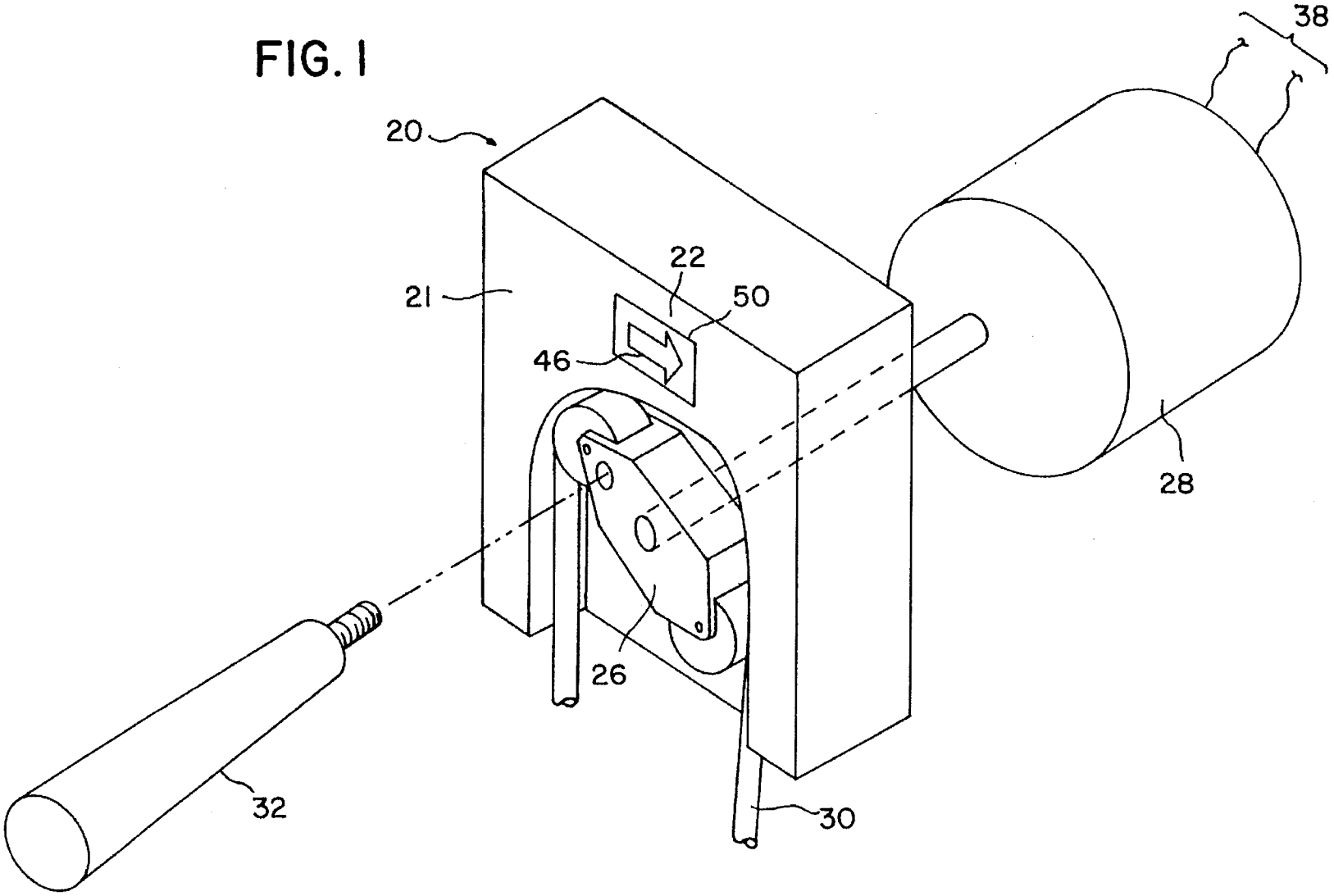
FIG. 1 is a partially diagrammatic perspective view of a peristaltic pump incorporating a first preferred embodiment of the present invention comprising a passive rotation direction indicator assembly.
Figure 2:
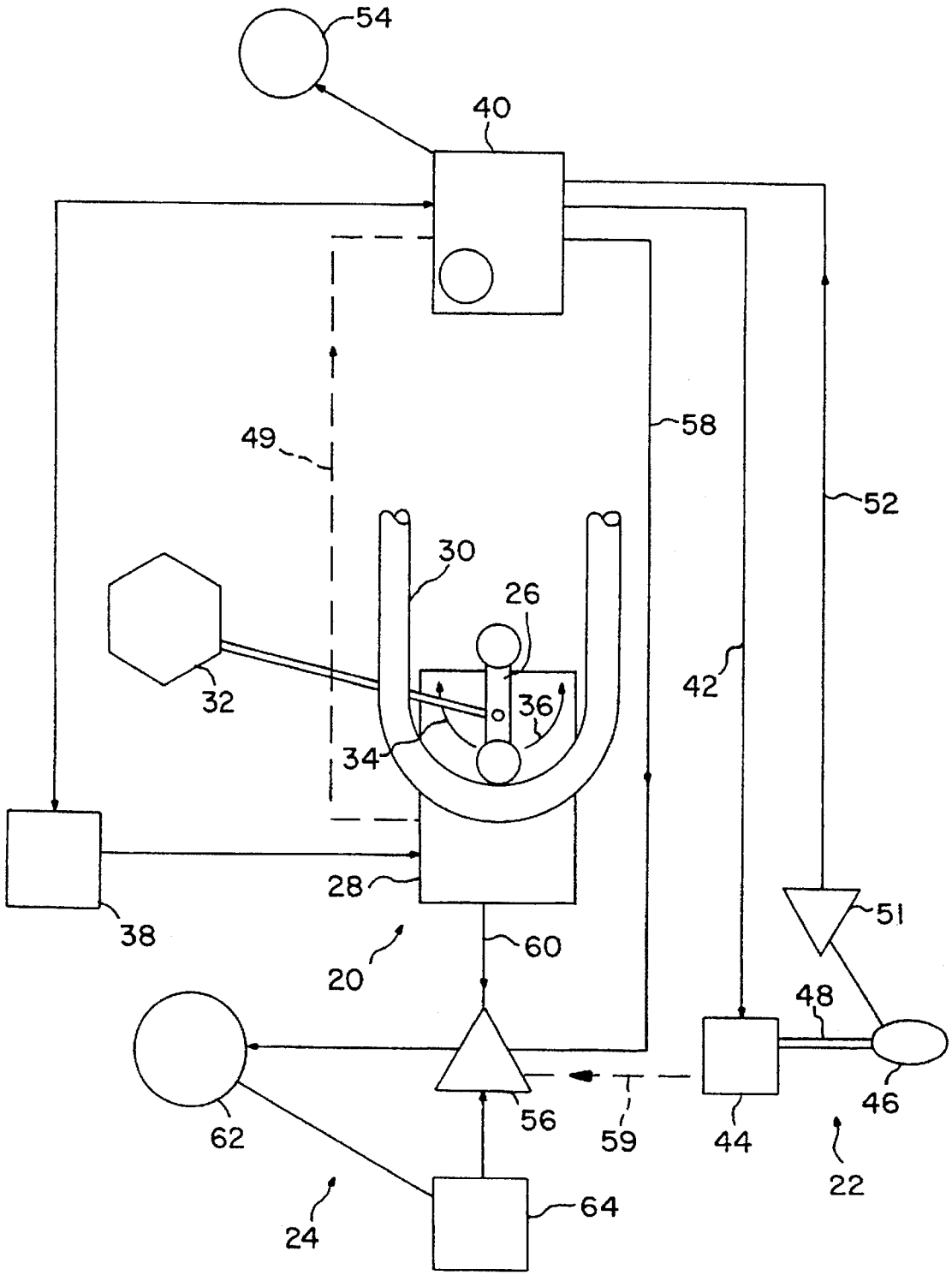
FIG. 2 is a block diagram illustrating the peristaltic pump of FIG. 1 incorporating the first preferred embodiment of the present invention comprising a passive rotation direction indicator assembly and further comprising a rotor reversal alarm assembly.

FIGS. 1 and 2 illustrate a first preferred embodiment of the present invention comprising a conventional peristaltic pump 20 incorporating a passive rotation direction indicator assembly 22 and a rotor reversal alarm assembly 24. The peristaltic pump 20 comprises a rotor assembly 26, which is typically driven by an electric motor 28 to progressively occlude a typical flexible medical tube 30, thereby impelling a fluid, such as blood, through the flexible tube 30 in a well known manner. The motor 28 may drive the rotor 26 directly, as illustrated, or through a belt or gear drive mechanism, as is well known. In the event of an electrical failure and some mechanical failures of the electric motor 28 drive of the rotor assembly 26 a manual crank handle 32 may be releasably interconnected with the rotor assembly 26 so that the rotor may be rotated by hand.

In many applications it is desirable for the pump 20 to selectably impel fluid through the flexible tube 28 in either the clockwise direction, indicated by a clockwise direction arrow 34, or the counterclockwise direction, indicated by a counterclockwise direction arrow 36. Thus, either the electric motor 28 or the crank handle 32 may rotate the rotor 26 in either the clockwise direction 34 or the counterclockwise direction 36. The electric motor 28 is energized by a motor power supply source 38 which is controlled by a controller 40 to turn the motor 28 on and off, to vary the motor's speed, and thus the rotor assembly's 26 speed, and to set the motor's 28 direction as either clockwise 34 or counterclockwise 36, using any of several well known techniques. In the preferred embodiment the motor power supply source 38 provides electrical power typically at 24 to 48 volts dc and is derived from the typical single phase ac power available in a hospital. As will be described below, in some instances an ac power source may be used with the present invention.

The controller 40 monitors and controls the pump 20. The controller 40 may comprise one or more typical microprocessors as are well known for equipment control, and other components.

When the controller 40 sets the motor 28 rotation in either the clockwise 34 or counterclockwise 36 direction, a first direction indicator electrical interconnection 42 to the passive rotation direction indicator assembly 22 activates a non-returning actuator 44 of the passive rotation direction indicator assembly 22. The non-returning actuator 44 is mechanically connected to a direction indicator 46 by a connecting linkage 48. The controller 40 establishes motor 28, and thus rotor 26, rotation direction or it may, alternatively, detect the motor 28 or rotor 26 rotation direction monitoring the voltage of the drive motor 26 or by way of any of several well known direction or motion detectors connected to the controller 40 by a direction monitoring electrical connection 49. In any event, the controller 40, accordingly, positions the non-returning actuator 44 and, therefore, the direction indicator 46 to reflect the direction in which the drive motor 28 and is rotating the rotor assembly 26. The direction indicator 46 is positioned to give a visible indication of rotor direction, as through a window 50 in a front panel 21 of the pump 20 visible to a perfusionist from the front of the pump 20. Although the window 50 is illustrated above and centered on the rotor assembly 26 of the pump 20, it may, of course, be located at any convenient location on the pump 20 where it will be visible to, and readily interpreted by, the perfusionist.

The present invention may optionally comprise a position sensor 51. The position sensor 51 detects the position of the direction indicator 46 and is connected to the controller 40 through a position sensor electrical connection 52 to report the direction indicator's position to the controller 40. The controller 40 may then compare the position of the direction indicator 46 with the rotor assembly 26 rotation direction 34, 36 to determine whether the direction indicator 46 has been positioned erroneously. If the position sensor 51 detects a direction indicator 46 which does not agree with the information available to the controller 40 about the set, or optionally the actual, rotor assembly 26 rotation direction, it may alert the perfusionist of the situation by activating an audible or visual indicator failure alarm 54.

The rotation reversal alarm assembly 24 of the first preferred embodiment of the present invention comprises a reversal sensing circuit 56 which detects the rotation direction 34, 36 in which the motor 28, and thus the rotor assembly 26, have been set by the controller 40 through a second direction indicator electrical connection 58, referred to herein as the desired rotation direction. Alternatively, the reversal sensing circuit 56 may sense rotation of the motor 28 or rotor assembly during normal operation directly by any of several known techniques to determine the desired rotation direction. Such techniques may comprise sensing drive motor back electromagnetic force (EMF) polarity, tachometer polarity, or using any quadrature sensing device, such as optical or mechanical encoders. Further, the non-returning actuator 44 of the passive rotor direction indicator assembly 22 may be provided with means such as travel limit switches (not shown) through an electrical interconnection 59 to provide the reversal sensing circuit with information regarding the desired rotation direction of motor 28 and rotor assembly 26 rotation. The reversal sensing circuit 56 retains the information about motor 28 or rotor assembly 26 direction during an immediately previous period of normal operation, i.e. the desired rotation direction, after the motor 28 and pump 20 are stopped, as for a motor 28 or power supply 38 failure. The reversal sensing circuit 56 is connected to the motor 28 through a hand crank direction indication electrical connection 60. The reversal sensing circuit 56 compares the retained information about the desired rotation direction of the motor 26 or rotor assembly 26 rotation with the direction 34, 36 of motor 28 or rotor assembly 28 rotation during hand cranking and actuates a visual or audible rotor reversal alarm 62 if the desired direction and the hand crank direction are not the same. Since the reversal sensing circuit 56 and audible and visual alarm 62 must function when the pump 20 is inoperative, as from a failure of power supply, the reversal sensing circuit 56, may be energized by the electromotive force generated in the motor 28 by manually rotating the peristaltic pump's 20 rotor assembly 26 or by an independent power source 64 such as a battery, for example a rechargeable NiCad battery or a lithium battery, or a storage capacitor. The reversal sensing circuit 56, is designed to differentiate between desired and undesired motor 28 or rotor assembly 26 rotation and to detect a change in motor 28 or rotor assembly 26 rotation direction 34, 36 from the direction in which it was last known to be rotating. The reversal sensing circuit 56 activates the rotor reversal alarm 62 when it detects an undesired motor 28 or rotor assembly 26 rotation that deviates from its last known rotation direction. The rotor reversal alarm 62 is energized by an independent power source which may be the same power source 64 used to energize the reversal sensing circuit 56. The rotor reversal alarm 62 may also be energized by motor or tachometer EMF.

Figure 3:
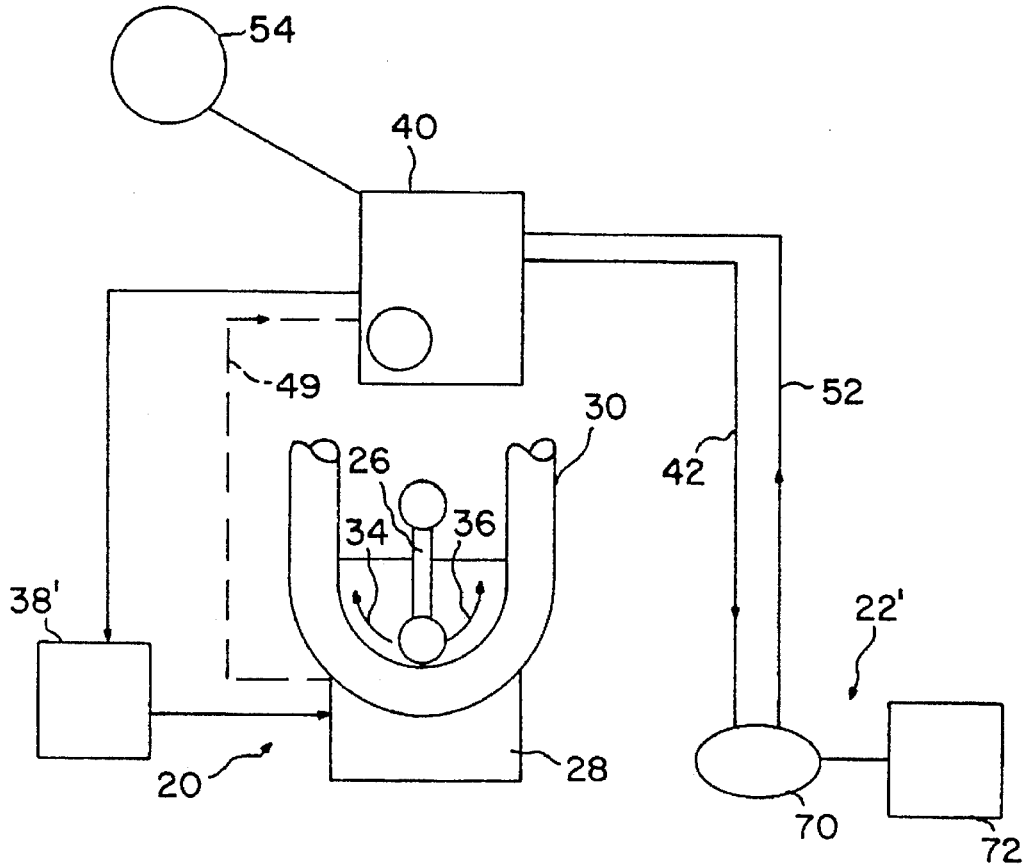
FIG. 3 is a partial block diagram illustrating a second preferred embodiment of the passive rotation direction indicator assembly of the present invention illustrated in FIG. 2.

FIG. 3 illustrates a second preferred embodiment of the passive rotation direction indicator assembly 22' in which the direction indicator is a powered display 70. The powered display 70 is connected directly to the controller 40 the first direction indicator electrical interconnection 42 and may optionally be connected by the position sensor electrical connection 52. The controller 40 sets the powered display 70 to indicate the direction 34,36 in which the motor 28 and rotor assembly 26 are travelling. The controller 40 may periodically check the powered display 70 to compare the direction that it is indicating with the actual rotor travel direction 34,36 during normal operation. If it detects an error it alerts the pump user of the error by activating an alarm 54.

Because it is necessary for the powered display 70 to be operative when the pump 20 is inoperative, as when there is no external power available, the powered display must be energized by a power source 72 that is independent from the power source 38 used to energize the drive motor 28 and controller 40. The independent power source 72 may be a battery, such as a rechargeable NiCad battery or a lithium battery or may be a storage capacitor. The powered display 70 is preferably selected to be a device having a low power consumption, for example a liquid crystal display, or one or more light emitting diodes. The low power consumption of the powered display device 70 will prolong the life of the independent power source 72.

Figure 4:
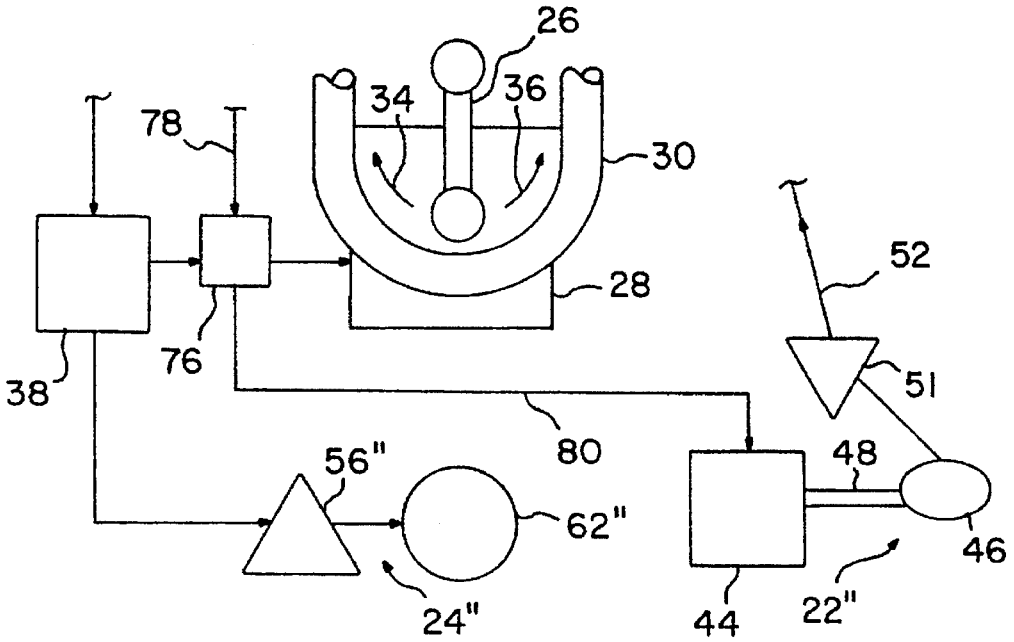
FIG. 4 is a partial block diagram illustrating a third preferred embodiment of the passive rotation direction indicator assembly and a second preferred embodiment of the rotor reversal alarm assembly of the present invention illustrated in FIG. 2.

FIG. 4 illustrates a third preferred embodiment of the passive rotation direction indicator assembly 22" and a second preferred embodiment of the rotor reversal alarm 24" in which the direction 34, 36 of rotation of the motor 28 and rotor assembly 26 is established by a latching relay 76 interposed between the motor power supply source 38 and the motor 28, which controls the motor 28 direction 34, 36 in a well known manner in response to an electrical signal 78 from the controller 40 (FIG. 2). The latching relay 76 may be provided with auxiliary contacts (not shown) which are electrically connected 80 to the non-returning actuator 44 to position the non-returning actuator 44 to indicate rotation direction as described above. Of course, auxiliary contacts (not shown) on the latching relay 78 may also, or may alternatively, provide desired rotation direction information to the reversal sensing circuit 56 (FIG. 2) of the first embodiment of the rotor reversal alarm assembly 24 (FIG. 2) described above instead of, or in addition to, the information provided by the electrical connection 58 to the controller 40.

In the second preferred embodiment of the rotor reversal alarm assembly 24" a polarized reversal sensing circuit 56" is provided connected to the source of power 38 for the motor. The polarity of the circuit 56" is selected so that when a voltage having the same polarity as the power supply 38 is applied to the circuit 56", a connected audible or visual alarm 52" is off or silent, and when a voltage is applied that is the reverse of the power supply 38 voltage the audible or visual alarm 52" is on or sounding. When the motor 28, a dc motor, is hand cranked in the same direction as that established by the latching relay 76, the latching relay 76 will apply a back-EMF from the motor 28 to the reversal sensing circuit 56" that has the same polarity as the power supply 38 causing no reaction by the audible or visual alarm 52'. When the motor 28 is hand cranked in the opposite direction from that established by the latching relay 76, the latching relay 76 will apply a back-EMF from the motor 28 to the reversal sensing circuit 56" that has the opposite polarity to that of the power supply 38 causing the audible or visual alarm 52" to turn on or sound. The audible or visual alarm 52" can be selected so that the back-EMF from hand cranking the motor 28 is sufficient to power the alarm 52".

Figure 5:
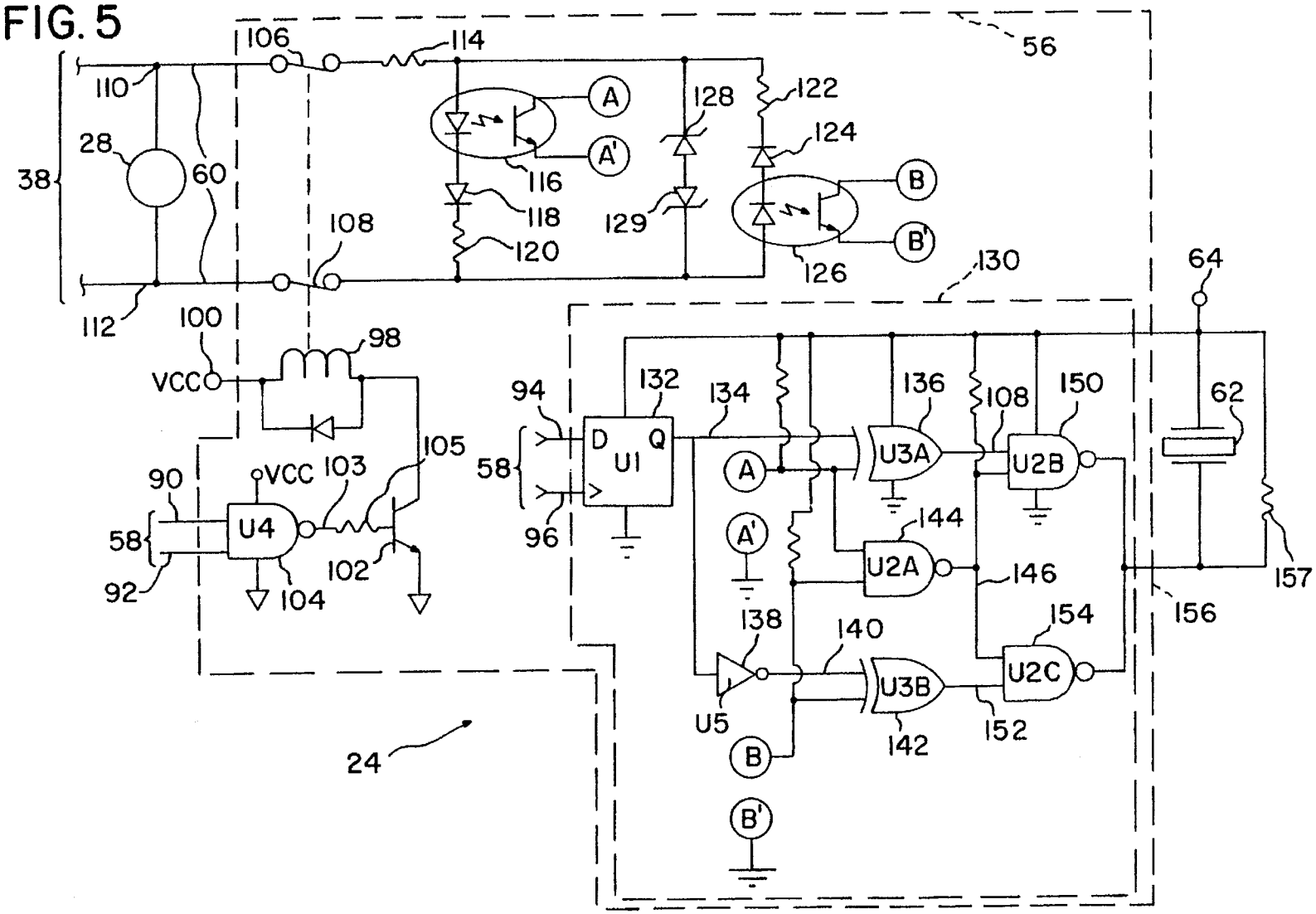
FIG. 5 is a schematic diagram illustrating one electrical circuit embodiment of the rotor reversal alarm assembly illustrated in FIG. 2.

FIG. 5 is an electrical schematic diagram illustrating one embodiment of the rotor reversal alarm assembly 24 of the present invention as illustrated in FIG. 2. Used herein, "high" refers to a high logic state while "low" refers to a low logic state. The rotor reversal alarm assembly 24 comprises the reversal sensing circuit 56 and an audible or visual alarm device 62 and is powered at least in part by an external source of power 64, such as a battery.

In the preferred embodiment, the controller 40 may comprise two microprocessors (not shown), sometimes designated a control microprocessor and a monitor microprocessor which perform redundant functions to enhance pump safety. The failure of both of these microprocessors is an indication of loss of the ability of the controller 40 to control the pump 20 in its normal fashion. Accordingly, the second direction indication electrical connection 58 comprises a control microprocessor reset signal 90, a monitor microprocessor reset signal 92, a first commanded rotor rotation direction signal 94 and a latching strobe signal 96.

A power failure relay, 98 is connected into a source of power 100 which is energized only when power is available to the pump assembly 20 as a whole. An NPN transistor 102 is connected in series with the power failure relay 98 so that when power 100 is available and the NPN transistor 102 is turned on the power failure relay 98 is energized. The base of the NPN transistor 102 is connected to the output 103 of a first NAND gate 104 through a current limiting resistor 105 which has two input signals, the control microprocessor reset signal 90 and the monitor microprocessor reset signal 92. These signals 90, 92 are low when the corresponding microprocessor is reset and high when the corresponding microprocessor is running. Thus, when either the control microprocessor (not shown) or the monitor microprocessor (not shown) of the controller 40 is available for control of pump 20 the output 103 NPN transistor 102 is turned on. Alternatively, the first NAND gate 104 may be an open collector device (not shown) which operates the power failure relay 98 directly, eliminating the need for the transistor 102.

The power failure relay 98 is provided with two normally closed contacts 106, 108. The normally closed contacts are opened when the power failure relay 98 is energized, indicating that power 100 is available and that at least one of the microprocessors is available to control the pump 20 and closed when the relay 98 is de-energized indicating either that both microprocessors are unavailable to control the pump 20 or that there has been a failure of the power supply 100 to the pump 20. The motor 28 of the pump 20 is a dc motor having a first motor lead 110 and a second motor lead 112. The first normally opened contact 106 of the relay 98 is connected to the first motor lead 110.

A current limiting resistor 114 is connected in series with the first normally closed contact 106 and a parallel circuit comprising three parallel branches connected in series with the current limiting resistor 114. The three circuit branches are connected in series with the second normally closed relay contact 108 which is in turn connected to the second motor lead 112. The first parallel branch comprises a first optical isolator 116 in series with an optional noise suppressing diode 118 and a resistor 120, the first optical isolator 116 being connected to turn on when current flows from the first motor lead 110 to the second motor lead 112. A second parallel branch comprises resistor 122, an optional noise suppressing diode 124 and a second optical isolator 126 connected to turn on when current flows from the second motor lead 112 to the first motor lead 110. The third parallel branch comprises a back-to-pack pair of Zener diodes 128, 129. The current limiting resistor 114 and the Zener diodes 128, 129 cooperate to limit the current flowing in the optical isolator circuits.

When the pump 20 has power available and at least one microprocessor (not shown) available, causing the power failure relay 98 to be energized, the normally closed contacts 106 and 108 are open and the optical isolators 116, 126 are disconnected from the leads 110, 112 of the motor 28. When power fails, or when both microprocessors (not shown) become unavailable for control, the power failure relay 98 de-energizes, closing the normally closed contacts 106, 108 and connecting the optical isolators 116, 126 in parallel with the motor 28 and with each other.

When the dc motor 28, is hand cranked it will generate a dc back EMF. The polarity of the back EMF generated by hand cranking the motor 28 will be dependent on the direction of cranking. For a first direction of cranking the motor 28, the first motor lead 110 will be positive with respect to the second motor lead 112 causing the noise suppression diode 118 and the first optical isolator 116 to conduct turning on the first optical isolator 116. When cranked in the opposite direction the second motor lead 112 will have a positive polarity with respect to the first motor lead 110 causing current to flow through the second optical isolator 126 and second noise suppression diode 124 turning on the second optical isolator 126. The first optical isolator 116 has an optically isolated output A, A' and the second optical isolator 126 has an optically isolated output B, B'. The optical isolator 116, 126 optically isolated outputs A, A' and B, B' are connected to a logic sub-circuit 130. The logic sub-circuit 130 is powered by the independent source of power 64 such as a battery.

The commanded rotor direction signal 94 provides a memory setting input to a memory flip-flop 132 of the logic sub-circuit 130 indicative of commanded rotation direction. The latching strobe signal 96 latches the commanded rotation direction signal 94 into the memory flip-flop 132. An output 134 of the memory flip-flop 132 is high when the last latched in commanded rotor direction signal 94 is high from the controller 40 and low when the last latched in commanded rotor direction signal 94 is low from the controller 40. The output 134 of the memory flip-flop 132 serves as an input to a first exclusive-OR gate 136 and to an inverter 138. The inverter 138 output 140 serves as an input to a second exclusive-OR gate 142. The optically isolated output A of the first optical isolator 116 serves as the second input to the first exclusive-OR gate 136 and the output B of the second optical isolator 126 serves as a second input to the second exclusive-0R gate 142. The output of the first exclusive-OR gate 136 is high when either the first optical isolator 116 output A is high or the output 134 of the memory flip-flop 132 is high and low when both are high or both are low. The output of the second exclusive-0R gate 142 is high when either the output B of the second optical isolator 126 is high or the output 140 of the inverter 138 is high indicating that the output 134 of the memory flip-flop 132 is not high, and low when both are high or both are low. The output A of the first optical isolator 116 and the output B of the second optical isolator 126 each form inputs to a second NAND gate 144 whose output 146 is low when both the output A of the first optical isolator 116 is high and the output B of the second optical isolator 126 is high. The output 146 of the second NAND gate 144 is high otherwise.

The output 148 of the first exclusive-OR gate 136 and the output 146 of the second NAND gate 144 serve as inputs to an open collector third NAND gate 150. Similarly, the output 152 of the second exclusive-OR gate and the output 146 of the second NAND gate 144 serve as inputs to an open collector fourth NAND gate 154. The outputs 156 of the third NAND gate 150 and the fourth NAND gate 154 are tied together and connected to the audible or visual alarm device 62, which may be a self contained piezoelectric sounding device with internal oscillating circuitry. The signal device 62 and a pull up resistor 157 are connected between the independent source of power 64 and the output 156 of the third and fourth NAND gates 150, 154, so that it is turned on when either output is in a low state.

The operation of the logic subcircuit 130 can best be understood by referring to the truth table 159 of FIG. 6 which illustrates the functioning of the circuit when the power failure relay 98 has been de-energized, thereby activating the direction reversal sensing circuit 56. The truth table 159 is based on the assumption that the commanded pump direction signal 94 being high is indicative of a desired clockwise rotation direction and that the commanded pump direction signal 94 being low is indicative of a desired counter-clockwise rotation. The truth table 159 is further based on the assumption that when the motor 28 is rotated in the clockwise direction the first motor lead 110 is negative with respect to the second motor lead 112 causing the second optical isolator 126 to turn on and its output B to go low and, conversely when the motor 28 is rotated in the counter-clockwise direction the first motor lead 110 is positive with respect to the second motor lead 112 causing the first optical isolator 116 to turn on and its output A to go low. Of course, by adjusting the polarities of the elements the reverse situation can easily be accommodated.

When the pump motor 28 is stationary, both optical isolators 116, 126 are turned off and so the outputs A, B are both high. This drives the output of the second NAND gate 144 low, which prevents actuation of the alarm device 62 by keeping the outputs of the third NAND gate 150 and fourth NAND gate 154 high.

When the motor 28 is correctly hand cranked in the clockwise direction, the current flows through the second optical isolator 126 turning it on and driving its output B B'. The output of the memory flip-flop will be high indicating that clockwise rotation is correct. This will cause the first and second exclusive OR gates 136 and 142 to both have low outputs 148, 152, thereby causing the output 156 of the third and fourth NAND gates 150, 154 to remain high holding the alarm 62 off. Similarly, when the pump 28 is correctly rotated in the counterclockwise direction, current will flow through the first optical isolator 116 driving the output A of the first optical isolator 116 low which, in conjunction with a low output 134 from the memory flip-flop 132, will cause the exclusive-OR gates 136, 142 to keep the output 156 of the third and fourth NAND gates 150, 154 high, again keeping the alarm 162 off.

If, however, the pump 28 is rotated in the clockwise direction and the last commanded pump direction signal 94 received by the memory flip-flop 132 was low, corresponding to a desired counterclockwise rotation, the output 134 of the memory flip-flop will be low which, when combined with the high output from the output A of the first optical isolator 116 and the low output B from the second optical isolator 126, will cause the outputs 148, 152 of the exclusive-OR gates 136, 142 to go high driving the output of the third and fourth NAND gates 150 and 154 both low, thereby turning on the alarm 62. Of course, the reverse is true for counter-clockwise rotation when the last commanded direction 94 was for clockwise rotation.

Figure 7:
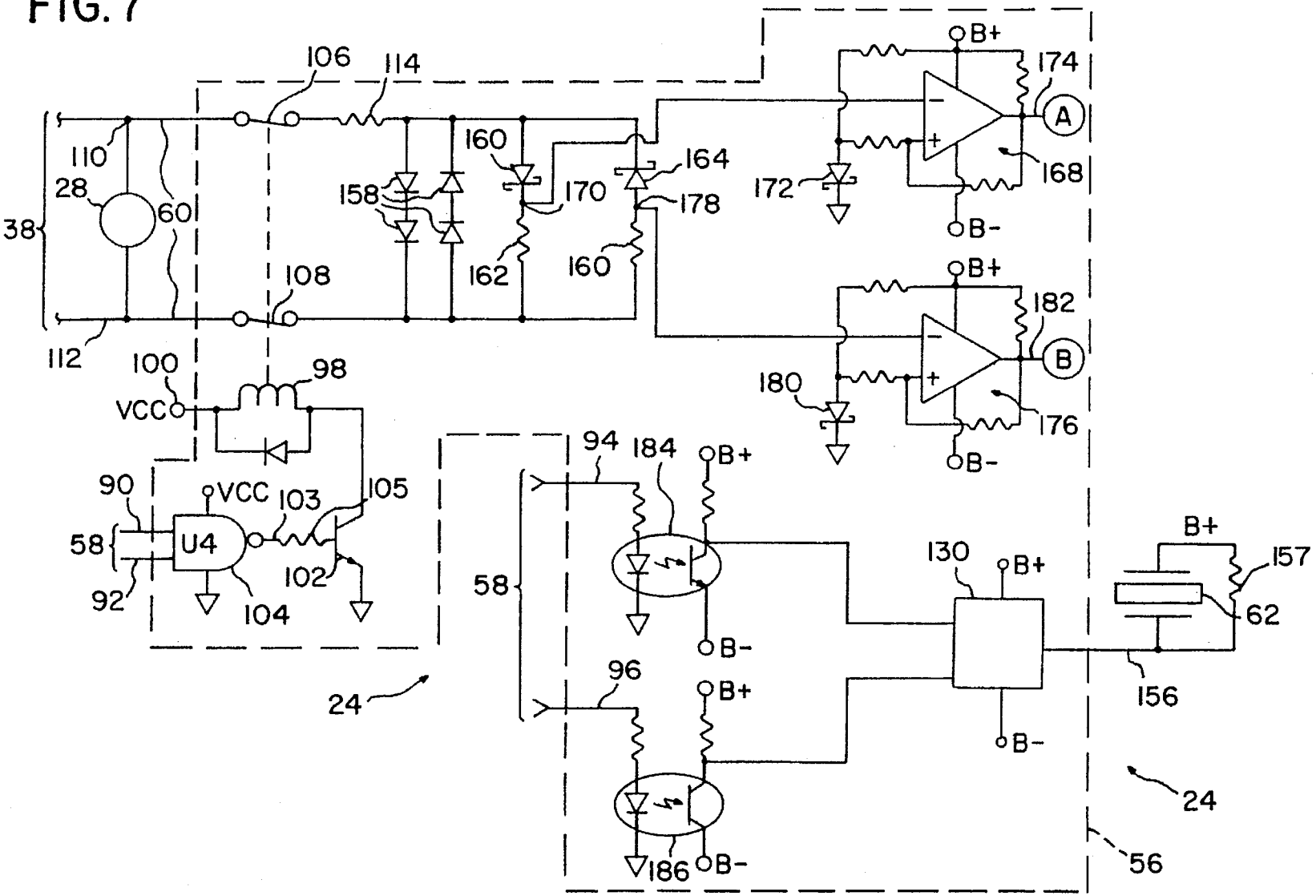
FIG. 7 is a schematic diagram illustrating another electrical circuit embodiment of the rotor reversal alarm assembly illustrated in FIG. 2.

FIG. 7 illustrates another preferred embodiment of the rotor reversal alarm assembly 24 of the present invention. In this embodiment the current limiting resistor 114 is connected to the first motor lead 110 and is in series with a parallel circuit having four branches, which is in turn connected to the second motor lead 112. The first and second branch of the parallel circuits each comprising two diodes 158 connected in series, the two series diodes 158 each being oriented with the same polarity with the parallel branches being oriented with opposite polarity. The resistor 114 and diodes 158 work together to limit the amount of current which can flow in the two remaining branches of the parallel circuit, which are rotation direction sensing branches.

A third branch of the parallel circuit comprises a Schottky diode 160, selected to maximize the sensitivity of the circuit, in series with a current sensing resistor 162. The first Schottky diode 160, connected to the current limiting resistor and is oriented to permit current to flow only from the first motor lead 110 to the second motor lead 112. The fourth parallel branch comprises a second Schottky diode 164 connected to the current limiting resistor 114 and oriented to conduct current from the second motor lead 112 to the first motor lead 110. The second Schottky diode 164 is in series with a second current sensing resistor 166, which is connected to motor lead 112. A first low power comparator circuit 168 compares the voltage at a point 170 between the first Schottky diode 160 and the first current sensing resistor 162 to a reference voltage across a third Schottky diode 172, providing a logical output signal 174 which serves to provide rotation direction information to point A of the logic sub-circuit 130. Similarly a second low power comparator circuit 176 compares the voltage at a point 178 between the second Schottky diode 164 and the second current sensing resistor 166 with a reference voltage across a fourth Schottky diode 180, providing a logical output signal 182 which serves to provide rotation information to point B of the logic sub-circuit 130.

Because of the difference in ground reference voltages it is desirable to optically isolate the commanded rotor direction signal 94 and the latching strobe signal 96 from the logic sub-circuit 130. For this purpose a third optical isolator 184 is provided to optically isolate the commanded rotor direction signal 94 and a fourth optical isolator 186 is provided to optically isolate the latching strobe signal 96.

The forgoing description of the rotor reversal alarm assembly 24 has been presented by reference to a conventional dc motor 28 with brushes. When the rotor assembly 26 of the pump 20 is driven by a different type of motor, such as a brushless dc motor, ac motor or stepper motor a conventional dc tachometer may be coupled to the motor 28 or the rotor assembly 26 and will directly replace the motor 28 in the embodiment 24 of FIGS. 5–7.

Figure 19:
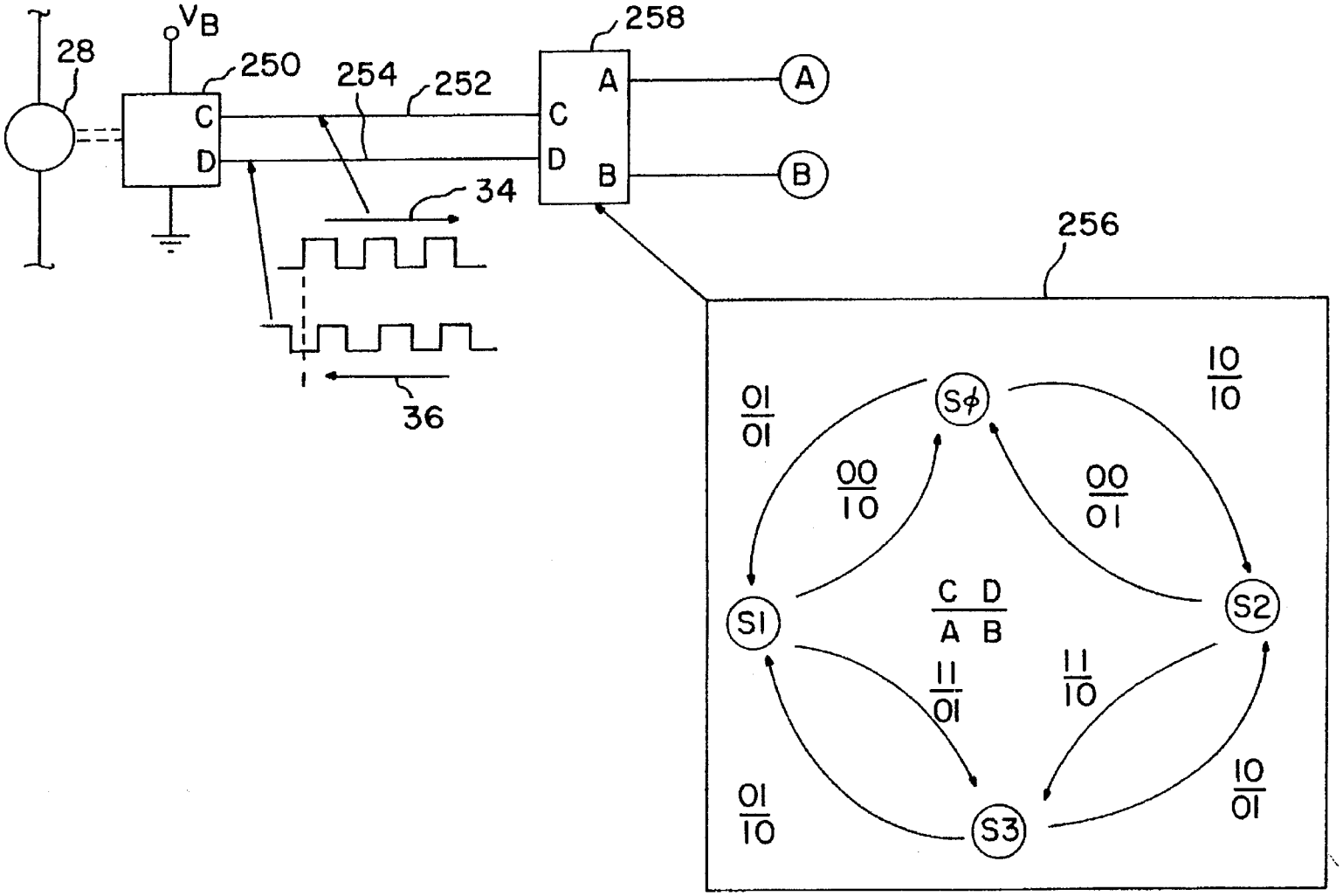
FIG. 19 is a partial schematic diagram and a state transition diagram illustrating an alternative embodiment of a portion of the rotor reversal alarm assembly illustrated in FIGS. 5 and 9.

Further, in lieu of sensing rotation direction by monitoring drive motor 28 polarity, a quadrature output optical encoder 250 may be provided as illustrated in FIG. 19. The quadrature output optical encoder would provide quadrature pulse output 252, 254 which would be analyzed in a well known manner 256 by a complementary metal oxide semiconductor (CMOS) state machine 258 to produce the rotation direction signal inputs A, B for the logic subcircuit 130.

Figure 8:
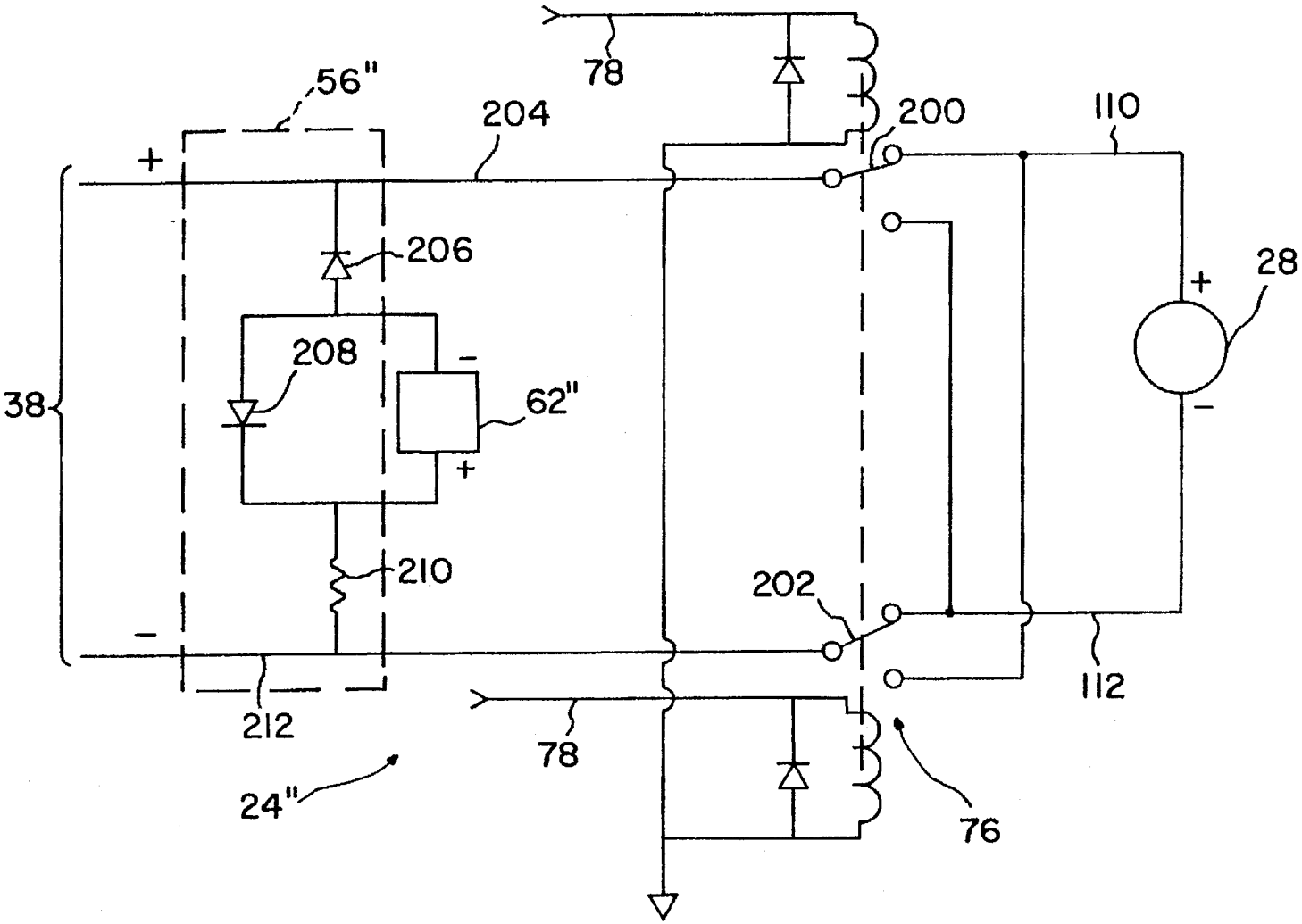
FIG. 8 is a schematic diagram illustrating an electrical circuit embodiment of the rotor reversal alarm assembly illustrated in FIG. 4.

FIG. 8 illustrates yet another embodiment of the rotor reversal alarm assembly 24" useful where a mechanically latching, double-pole double-throw relay 76 is provided to control motor direction in response to direction signals 78 from the controller 40. A back EMF sensing circuit 56" may be provided to actuate the audible or visual alarm 62". In this case double-throw contacts 200, 202 of the relay 76 are interposed between the power supply 38 to the motor 28 and connected in a well known manner for reversing operation of a dc motor. Connected ahead of the contacts 200, 202 of the latching relay 76 is the sensing circuit 56" which comprises a diode connected to a first, normally positive polarity, lead 204 of the power supply 38, the diode being connected so that it blocks the flow of current from the first lead 204 and conducts current to the first power supply lead 204. The diode is then connected in series with a parallel connection of a Zener diode 208 connected to conduct current from the first power supply lead 204 which is in turn connected in parallel with a self contained audible alarm device 62" which, if polarization is required, is connected with its negative terminal towards the first diode 206. The parallel connection of the Zener diode 208 and the alarm device 62" is then connected in series with a current limiting resistor 210 which is, in turn connected, to a second, normally negative polarity lead 212 of the power supply 38. Depending on the operating voltage range of the audible alarm 62", the Zener diode 208 and resistor 210 may not be required. In this case, the branch with the Zener diode 208 will be open and the positive lead of the audible alarm 62" may be connected directly to the second lead 212 of the power supply 38.

The first power supply lead 204 is connected by the first single-pole double-contact 200 of the latching relay 76 to either the first lead 110 of the motor 28 or, alternately, to the second lead 112 of the motor 28. The second lead 212 of the power supply 38 is connected through the second single-pole double-throw contact 202 of the latching relay 76, to be connected to the second lead 112 of the motor 28 when the first lead 204 of the power supply 38 is connected to the first lead 110 of the motor 28 and to be connected to the first lead 110 of the motor 28 when the first lead 204 of the power supply 38 is connected to the second lead 112 of the motor 28. The direction signals 78 set the position of the latching relay 76, which may have two coils as shown or a single coil controlled by reversing the direction of current. The latching relay 76 then sets the motor 28, and thus the rotor assembly 26, direction of rotation.

In normal operation the first lead 204 of the power supply is positive and the direction of motor 28 rotation is determined by whether the double-pole double-throw contacts 200, 202 of the relay 76 are connected to make the first lead 110 of the motor 28 positive with respect to the second lead 112 of the motor 28 or to make the second lead 112 of the motor 28 positive with respect to the first lead 110 of the motor 28. Diode 206 will prevent current from flowing through the reverse sensing circuit 56" and hence through the audible alarm device 62", thereby preventing the audible alarm device 62" from sounding during normal operation.

When power is lost the relay 76, because of its latching characteristics, will retain its previous position. The polarity of the reverse EMF that is superimposed during cranking on the leads 204, 212 of the power supply 38 will be the same as the normal voltage on those leads 204, 212 when the motor is cranked in the same direction as immediately preceding power failure. The alarm 62" will remain silent or off.

If, however, the motor 28, is cranked in the opposite direction, the back EMF generated by the motor 28 will have the reverse polarity from that which was applied to make the motor 28 rotate in the correct direction. In this event, the voltage applied on the leads 204, 212 of the power supply 38 will have a reverse polarity from normal. That is to say power supply lead 212 will be positive and power supply lead 204 will be negative. In this event the diode 206 will allow current to flow through the resistor 210 and alarm device 62" of the sensing circuit 56" thereby activating the alarm 62". Audible alarm device 62" is selected to either have its own self contained power supply or to have a power requirement coordinated with the current and back EMF generated by the pump motor 28 when rotated at low speeds.

A more sensitive circuit could be derived by utilizing a Schottky diode polarity sensing circuit, similar to that of FIG. 7, ahead of the alarm device 62".

If the motor 28 is not a conventional dc motor, then a dc tachometer may be substituted to provide direction signals to the sensing circuit 56" as an alternative to the back EMF of the motor 28.

Figure 9:
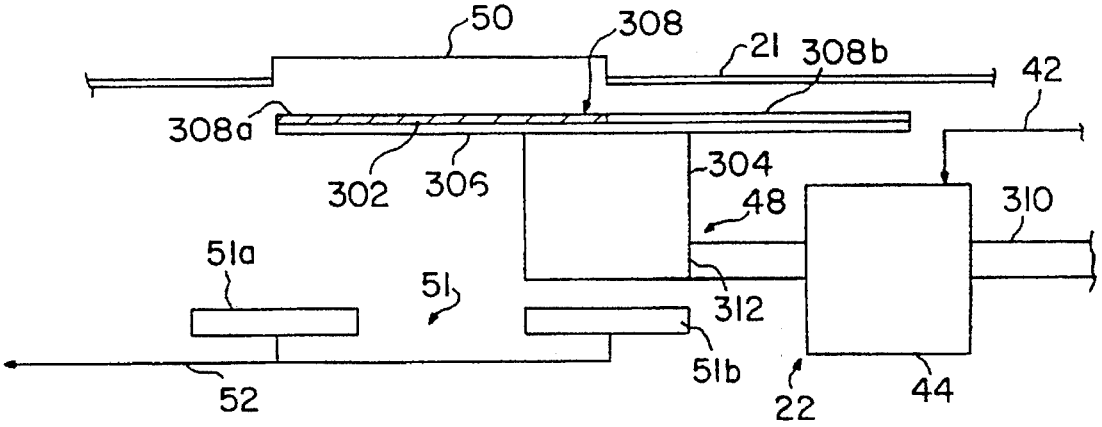
FIG. 9 is a diagrammatic sectional plan view of a mechanism for use with the passive rotor rotation indicator assembly illustrated in FIGS. 1, 2 and 4 with the mechanism in a retracted position.
Figure 10:
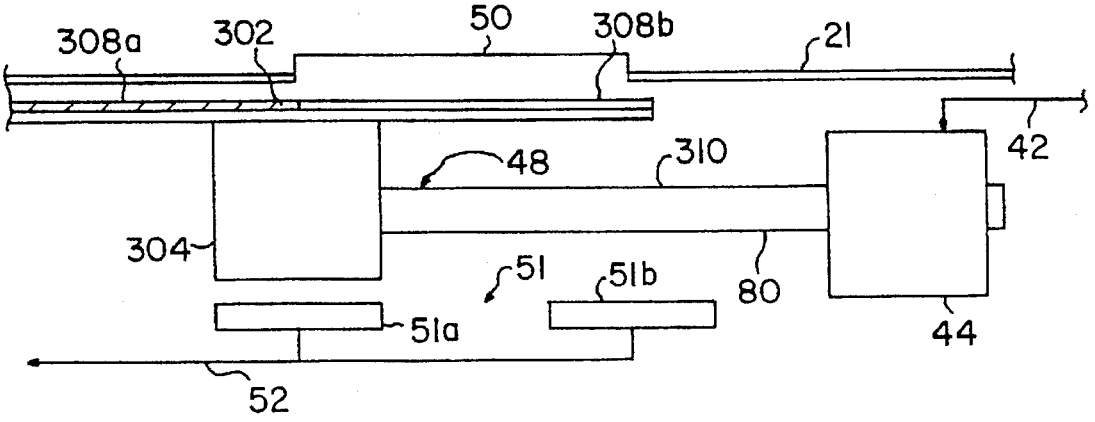
FIG. 10 is a diagrammatic sectional plan view of the mechanism illustrated in FIG. 9, with the mechanism in an extended position.
Figure 11:
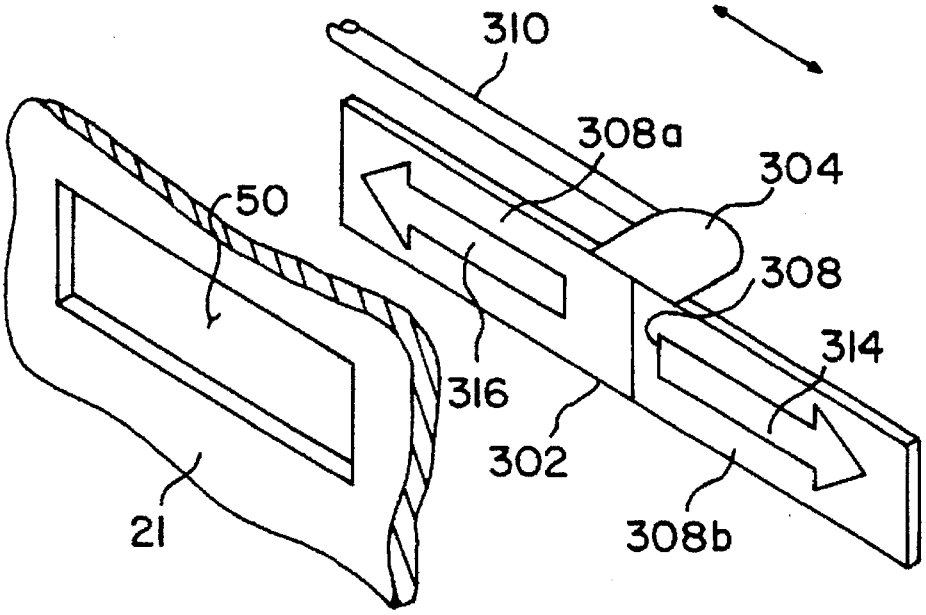
FIG. 11 is partial cut away perspective view of the mechanism of FIGS. 9 and 10.

FIGS. 9, 10 and 11 schematically illustrate one preferred embodiment of the mechanism by which the connecting linkage 48 of the non-return actuator 44 of the passive rotor rotation direction assembly 22 positions the direction indicator 46 beneath the pump window 50. As used herein the term "moveable indicator" refers to a card or wheel that is moveable either linearly or rotatively. An indicator card 302 is fixed to a post 304 at the indicator card's 302 bottom surface 306; thus, the indicator card 302 is oriented such that it's top surface 308 may be positioned to be visible through the pump 20 front panel 21 window 50. The indicator card's top surface 308 comprises a first 308*a* and second half 308*b*. Each half 308*a*, 308*b* further comprises means for indicating the rotor rotation direction 34, 36. The indicating means will be discussed in more detail below.

A shaft 310 is fixed to the post 304 at the shaft's first end 312 and the shaft's opposing end 216 contacts the non-returning actuator 44 which may comprise a linear stepper motor, a dual coil solenoid or any one of several well known reversing electrically powered actuators which hold their last position when power is removed from the actuator. While the pump 20 is operational, the controller 40 establishes or, optionally, detects, the direction of the motor rotation 34,36 as shown in FIG. 2. The direction of the motor 28 rotation 34, 36 correlates to the direction in which the rotor assembly 26 is rotating. The controller 40 then engages the non-return actuator 44, through the first direction indicator electrical interconnection 42. The non-return actuator 44 moves the shaft 310, post 304 and, therefore, the indicator card 302 to a position that reveals a portion of the card's top surface 308 beneath the pump window 50. As will be discussed in more detail below, the card's top surface 308 comprises indicating means predetermined to correlate to the rotor assembly rotation direction 34, 36.

The non-return actuator 44 may move the shaft 310, post 304 and, therefore, the indicator card 302 away from the non-return actuator 44 a relatively retracted position, as illustrated in FIG. 9, said position predetermined to correspond to one of the two rotation directions 34, 36 of the rotor assembly 26. Conversely, the non-return actuator 44 may move the shaft 310, post 304 and, therefore, the indicator card 302 away from the non-return actuator 44 a relatively extended position, as illustrated in FIG. 10, said position predetermined to correspond to the other one of the two rotation directions 34, 36 of the rotor assembly 26. In the retracted position the first half 308*a* of the top surface 308 of the indicator card 302 is visible through the pump window 50. In the extended position the second half 308b of the top surface 308 of the indicator card 302 is visible through the pump window 50. These predetermined relationships are fixed in the controller 40. If it is predetermined that the retracted position corresponds to the clockwise rotor rotation direction 34, the indicator card 302 will expose a clockwise symbol, such as a clockwise pointing arrow 314, through the window 50 of the pump panel 21 and, conversely, in the extended position a counterclockwise symbol, such as a counterclockwise pointing arrow 316, will be shown through the window. It will be apparent to those skilled in the art that the extended and retracted positions may correlate to either the clockwise 34 or counter clockwise 36 rotation direction as long as the controller 40 and indicator card 302 consistently reflect the predetermined correlation.

In the event that the peristaltic pump 20 or controller 40 loses power or fails for any reason, the non-returning actuator 44 must be capable of maintaining the post 304 and, consequently, the indicator card 302 in the same position in which they were oriented with respect to the window 50 in the pump panel 21 at the time of the system failure. By maintaining the indicator card 302 in same position, a pump user will be able to observe the direction 34, 36 in which the rotor assembly 26 was rotating immediately prior to system failure and, correspondingly manually rotate the rotor assembly 26 in that same direction 34,36 by means of the hand crank 32 engaged with the rotor assembly 26.

A position sensor 51 comprising at least one and preferably a pair of position detectors 51a, 51b may be optionally located in the pump 20 to detect the position of the post 302. A first position detector 51a may be located to detect the position of the post 304 when the non-return actuator 44 has positioned it in the extended position. A second position detector 51b may be located to detect the position of the post when the non-return actuator 44 has positioned it in the retracted position. The position sensor 51 reports the position of the post 304 to the controller 40 through the position sensor electrical connection 52. The controller 34 compares the reported position of the post 304 to the desired or actual direction 34, 36 in which the rotor assembly 26 is rotating. If the controller 34 detects an error, it notifies the pump user by an audible or visual alarm 54. It is preferred that the detectors 51a, 51b comprise Hall effect sensors, however it will be apparent to one skilled in the art that any suitable proximity sensor, position sensor or travel limit switch may be used.

FIG. 11 illustrates the top surface 308 of indicator card 302 that may be used in the first and third preferred embodiments of the passive rotor rotation direction indicator assembly 22, 22". The indicator card's 302 top surface 308 comprises a first half 308a and a second half 308b. Each card half 308a, 308b further comprises a symbol 314, 316 indicating rotor assembly 26 rotation direction 34, 36 (FIG. 2). It will be apparent to those skilled in the art that a variety of symbols can be used with the present invention as long they clearly indicate direction. For example, words, numbers, color schemes and drawings could be used.

FIG. 1 illustrates how the indicator card 302 of FIG. 11 would appear through the pump window 50 when the non-returning actuator 44 is in the retracted position.

Figure 12:
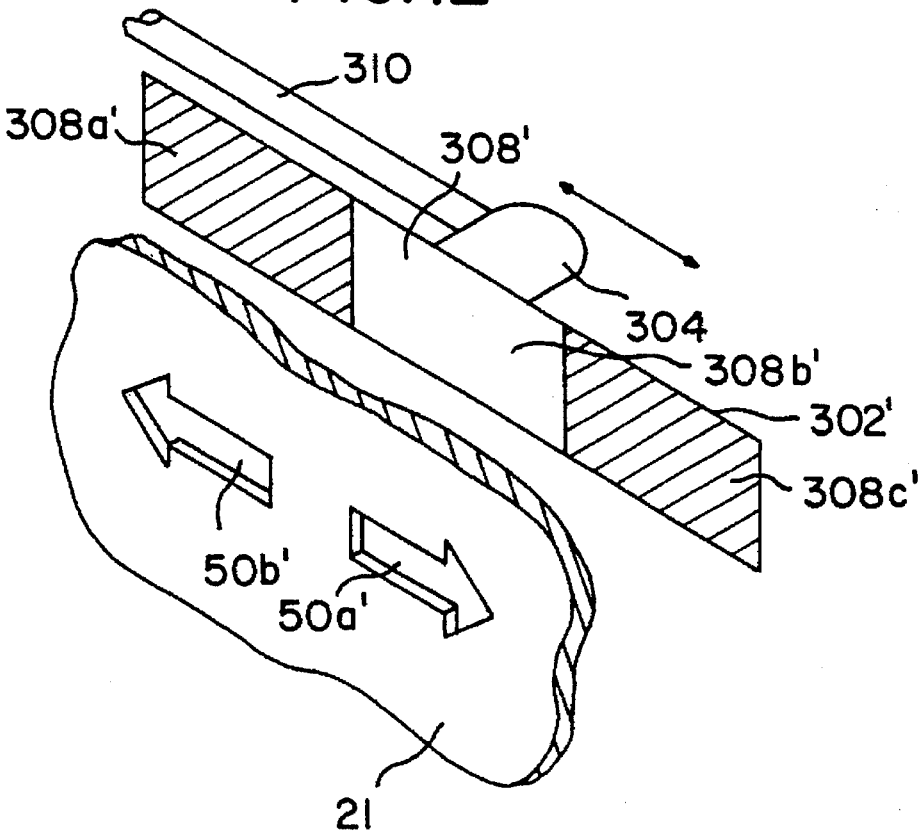
FIG. 12 is partial cut away perspective view of an alternative embodiment of the mechanism of FIG. 11.

FIG. 12 illustrates another embodiment of the indicator card 302'. The indicator card 302' has a top surface 308' divided into three parts 308a', 308b', 308c'. A center one 308b' of the three indicator card 302' parts is brightly colored, while two outer ones, 308a', 308b' are dully colored. The pump front panel 21 has two direction-symbolically shaped windows, 50a', 50b', one for each of the rotor assembly 26 rotation directions 34, 36. When non-return actuator 44 is in the extended position the brightly colored part 308b' of the top surface 308' of the indicator card 302' shows though a first one of the direction-symbolically shaped windows 50a' while the dully colored part 308a' proximal the non-return actuator 44 shows through the second one of the direction symbolically shaped widows 50b'. When non-return actuator 44 is in the extended position the brightly colored part 308b' of the top surface 308' of the indicator card 302' shows though the second one of the direction-symbolically shaped windows 50b' while the dully colored part 308c' distal the non-return actuator 44 shows through the first one of the direction-symbolically shaped widows 50a'.

Figure 13:
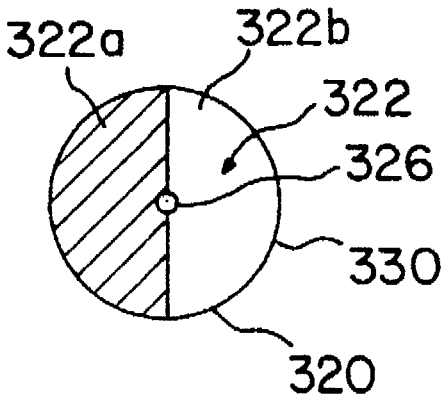
FIG. 13 is an elevational view of a portion of an alternative embodiment of the mechanism of FIGS. 9 and 10.
Figure 14:
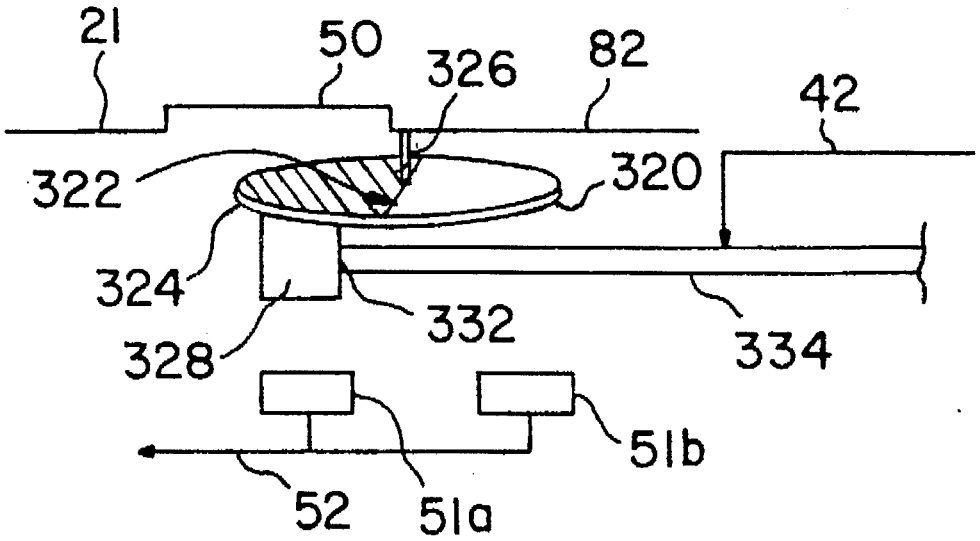
FIG. 14 is a diagrammatic partial sectional plan view of the mechanism of FIG. 13.

FIGS. 13 and 14 illustrate an indicator wheel 320 embodiment of the direction indicator 46 that may be used with the first and third preferred embodiments of the passive rotor rotation direction indicator 22, 22". The indicator wheel 320 comprises a top surface 322 and a bottom surface 324. The indicator wheel is pivotally attached to the pump front panel 21 by an axle 326 such that a portion 322a, 322b of the wheel's 320 top surface 322 may be visible through the pump window 50.

A post 328 is pivotally fixed to the wheel's 320 bottom surface 324 near the wheel's perimeter 330. A first end 332 of a shaft 334 of the non-returning actuator 44 (FIG. 2) is fixed to the post 328. The non-returning actuator 44 may be a linear stepper motor or a latching solenoid which is pivotally mounted to the panel front 21 to permit the end 332 of the shaft 334 of the actuator 44 to follow a circular path of the post 328 as the actuator 44 extends and retracts the shaft 334. Alternatively, the shaft 334 may be hinged at an intermediate point (not shown) in a well known manner, to permit the end 332 of the shaft 334 to follow the circular path of the post 328. Further, instead of the post 328 being pivotally mounted to the wheel 320 the end 332 of the shaft 324 may be pivotally mounted to the post 324. When the non-returning actuator is engaged by either the controller 40 or the latching relay 76 the post 328 is moved to the extended or retracted position. The indicator wheel's top surface has a first half 322a and a second half 322b. In the extended position, the indicator wheel 320 rotates about the axle 326 to expose to view the first half 322a of the indicator wheel's top surface 322 beneath the pump window 50. In the retracted position, the indicator wheel 320 rotates about the axle 326 to expose to view the second half 322b of its top surface 322 beneath the pump window 50.

The indicator wheel's 320 top surface 322 may comprise a variety of direction symbols as described for FIGS. 9–12. The indicator wheel 320 may also comprise a color scheme for indicating rotor rotation direction 34, 36. FIG. 13 illustrates a color wheel 320 having a first color on the first half 322a of its top surface 322 and a second color on the second half 322b. The first color may be correlated with the clockwise direction 34. When the indicator wheel 320 is pivoted by the non-returning actuator 44 to expose the first colored half 322a of the wheel's top surface 322, the perfusionist will be notified that the pump was travelling in the clockwise direction 34. The second colored half 322b is therefore correlated with the counterclockwise direction 36 of pump 20 rotation. It will be apparent to those skilled in the art that either color may be correlated with either the clockwise 34 or counter clockwise 36 rotor rotation direction.

The symbols, words, numbers, drawings and color schemes chosen to indicate rotor rotation direction 34, 36 may also be fashioned of material that is visible in the dark for a given period of time. This would allow the direction indicator 46 to remain visible to a pump user in the event that the lighting system with which the pump used also becomes inoperative. In accordance with this embodiment of the invention, a well-known phosphorescent material would be used to form direction indication characters or symbols on the indicator card or wheel, or to form the background for such characters or symbols. Alternatively, a back light requiring low energy, energized by the independent power source 64, could illuminate the symbols, words, numbers, drawings, and color schemes chosen to indicate rotor rotation direction 34, 36.

Figure 15:
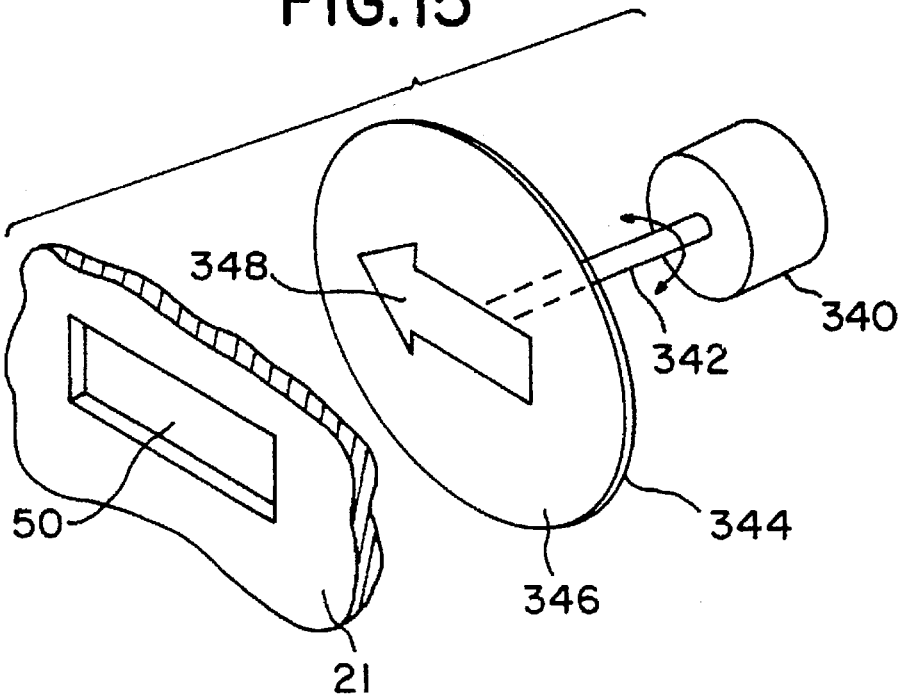
FIG. 15 is partial cut away perspective view of another alternative embodiment of the mechanism of FIGS. 9 and 10.
Figure 16:
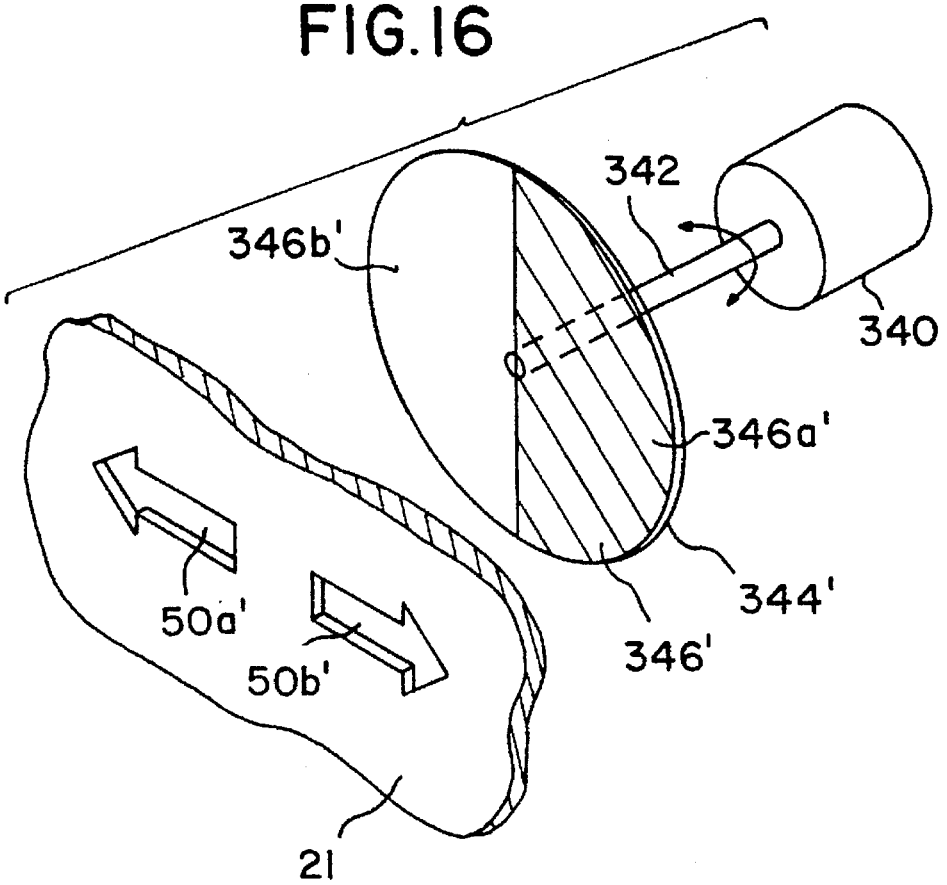
FIG. 16 is partial cut away perspective view of an alternative embodiment of the mechanism of FIG. 15.

FIG. 15 and 16 illustrate another embodiment of a mechanism that can be used for the non-returning actuator 44 of the first and third embodiments of the passive rotor rotation direction indicator 22, 22" of the present invention. In this embodiment the non-returning actuator comprises a rotary actuator 340 which rotates a rotary shaft 342, and thus an indicator wheel 344, 344' fixed to the shaft between first and second rotary positions, said rotary positions being separated by 180 degrees. The rotary actuator 340 may be any of several well known types, such as a rotary stepper motor, provided that the actuator 340 retains its last position when power is interrupted. The indicator wheel has a top surface 346 which may have a reversible direction symbol 348, such as a arrow, which shows through the window 50 of the pump front panel 21 or may be divided is divided into differently colored halves 346*a'*, 346*b'* which show through directional-symbolically shaped windows 50*a'*, 50*b'* in the panel 21.

Figure 17:
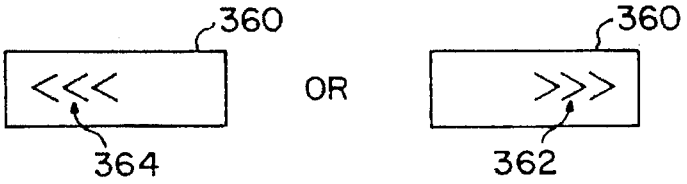
FIG. 17 shows a powered display useful with the passive rotor rotation indicator assembly illustrated in FIG. 3.
Figure 18:
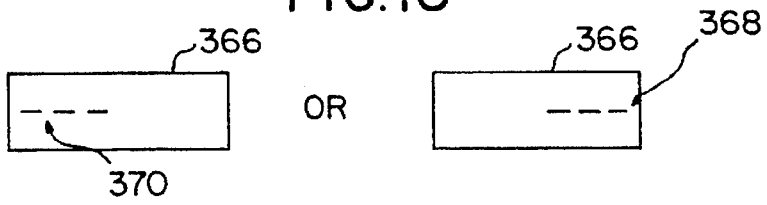
FIG. 18 shows an alternative embodiment of a powered display useful with the passive rotor rotation indicator assembly illustrated in FIG. 3.

FIGS. 17 and 18 illustrate embodiments of the powered display 70 of the second embodiment of the passive rotation direction indicator 22' of the present invention. FIG. 17 illustrates a six character LCD alphabetic character display or dot matrix display 360. For a first direction of rotation 34, 36 of the rotor assembly 26 three "greater-than" symbols or three right pointing carats 362 are displayed for the three right-most character positions of the display 360. For a second direction of rotation 36, 34 of the rotor assembly 26 three "less-than" symbols or three left pointing carats 364 are displayed for the three left-most character positions of the display. There are, of course, many variations of this display which will be apparent to one skilled in the art.

FIG. 18 illustrates a six character LCD numeric character display or dot matrix display 366. For a first direction of rotation 34, 36 of the rotor assembly 26 three "minus" symbols 368 are displayed for the three right-most character positions of the display 368. For a second direction of rotation 36, 34 of the rotor assembly 26 three "minus" symbols 370 are displayed for the three left-most character positions of the display. There are, of course, many variations of this display which will be apparent to one skilled in the art.

Although the present invention has been described with reference to preferred embodiments, numerous modifications and variations can be made and within the scope of the invention. No limitation with respect to the specific embodiments disclosed herein is intended or should be inferred.

We claim:

1. A pump apparatus comprising:

a rotative pump mechanism capable of being rotated in either a clockwise or a counterclockwise direction;

an electric motor drive which drives the pump mechanism;

a device adapted to permit a human pump operator to selectably manually drive the pump mechanism; and an indicator which provides information to the pump operator to inform the operator of the direction in which the pump mechanism was rotating when last driven by the electric motor.

2. The apparatus of claim 1 wherein the indicator provides a substantially continuous visual indication of the direction in which the pump mechanism was rotating when the pump was last driven by the electric motor.

3. The apparatus of claim 2 further comprising:

a non-returning actuator having two positions, said non-returning actuator assuming a first position when the pump mechanism is rotated by the electric drive motor in the clockwise direction and a second position when the pump mechanism is rotated by the electric drive motor in the counterclockwise direction, said actuator retaining its last position when the motor stops rotating the pump mechanism; and a visible device operatively coupled to the non-returning actuator, and visible to the operator of the pump assembly, which assumes a clockwise rotation indicative position when the actuator is in the first position and a counterclockwise indicative position when the actuator is in the second position.

4. The apparatus of claim 3 wherein the non-returning actuator comprises a linear actuator.

5. The apparatus of claim 4 wherein:

the pump assembly has a housing; and the indicator is located within the pump housing; and wherein the visible device comprises;

a moveable indicator linked to the non-returning actuator;

direction-symbolic markings on the moveable indicator comprising:

a first marking to indicate the clockwise direction; and a second marking to indicate the counterclockwise direction; and a window in the pump housing sized and situated with respect to the moveable indicator to cause the first marking to be visible through the window, and the second marking not visible through the window, when the non-returning actuator is in the first position and to cause the second marking to be visible through the window, and the first marking not visible through the window, when the non-returning actuator is in the second position.

6. The apparatus of claim 4 wherein:

the pump assembly has a housing; and the indicator is located within the pump housing; and wherein the visible device comprises;

a moveable indicator linked to the non-returning actuator;

colored markings on the moveable indicator comprising:

a first colored marking selected to be indicative of the presence of rotation; and a second colored marking selected to be indicative of the absence of rotation; and direction symbolic windows comprising a first window symbolic of clockwise rotation of the pump mechanism and a second window symbolic of counterclockwise rotation of the pump mechanism the windows being situated with respect to the moveable indicator to cause the first marking to be visible through the first window, and the second marking visible through the second window, when the non-returning actuator is in the first position and to cause the second marking to be visible through the first window, and the first marking visible through the second window, when the non-returning actuator is in the second position.

7. The apparatus of claim 3 wherein the non-returning actuator comprises a rotary actuator.

8. The apparatus of claim 7 wherein:

the pump assembly has a housing; and the indicator is located within the pump housing; and wherein the visible device comprises;

a moveable indicator linked to the non-returning actuator;

direction-symbolic markings on the moveable indicator comprising:

a first marking to indicate the clockwise direction; and a second marking to indicate the counterclockwise direction; and a window in the pump housing sized and situated with respect to the moveable indicator to cause the first marking to be visible through the window, and the second marking not visible through the window, when the non-returning actuator is in the first position and to cause the second marking to be visible through the window, and the first marking not visible through the window, when the non-returning actuator is in the second position.

9. The apparatus of claim 7 wherein:

the pump assembly has a housing; and the indicator is located within the pump housing; and wherein the visible device comprises;

a moveable indicator linked to the non-returning actuator;

colored markings on the moveable indicator comprising:

a first colored marking selected to be indicative of the presence of rotation; and a second colored marking selected to be indicative of the absence of rotation; and direction symbolic windows comprising a first window symbolic of clockwise rotation of the pump mechanism and a second window symbolic of counterclockwise rotation of the pump mechanism the windows being situated with respect to the moveable indicator to cause the first marking to be visible through the first window, and the second marking visible through the second window, when the non-returning actuator is in the first position and to cause the second marking to be visible through the first window, and the first marking visible through the second window, when the non-returning actuator is in the second position.

10. The apparatus of claim 7 wherein:

the pump assembly has a housing; and the indicator is located within the pump housing; and wherein the visible device comprises;

a moveable indicator linked to the non-returning actuator;

direction-symbolic marking on the moveable indicator comprising marking which is symbolic of the clockwise direction when positioned by the actuator in the first position and symbolic of the counterclockwise direction when the non-returning actuator is in the second position; and a window in the pump housing sized and situated with respect to the moveable indicator to cause the marking on the moveable indicator to be visible through the window.

11. The apparatus of claim 2 wherein the indicator further comprises:

an independent source of indicator power;

a memory device for retaining information about the immediately previous direction of pump mechanism rotation when driven by the electric motor; and a powered display device displaying information about direction of pump rotation, said powered display device deriving its power from the independent source of indicator power.

12. The apparatus of claim 11 wherein the memory device derives its power from the independent source of indicator power.

13. The apparatus of claim 1 wherein the indicator provides an indication that the operator is manually driving the pump mechanism in a direction different from the direction in which the pump mechanism was rotating when last driven by the electric motor.

14. The apparatus of claim 13 wherein the electric motor is a dc motor, further comprising:

a polarized source of dc electrical power having a positive lead and a negative lead;

a mechanically latched motor reversing relay interposed in the leads between the source of dc electrical power and the motor; and a reversal sensing circuit interposed between the source of dc electrical power and the reversing relay comprising:

an indicator device electrically connected between the positive lead and the negative lead; and a selectively conductive device connected to block the flow of electrical current through the indicator device from the positive lead to the negative lead and to allow the flow of electrical current through the indicator device from the negative lead to the positive lead.

15. The apparatus of claim 14 wherein the indicator device is powered by current generated by back EMF generated by manually rotating the motor.

16. The apparatus of claim 13 further comprising:

an independent source of electrical power;

an indicator device powered by the independent source of electrical power;

a reversal sensing circuit powered by the independent source of electrical power comprising:

engaging circuit for engaging the sensing circuit when electric power is unavailable to the pump;

memory circuit for storing information about the last direction in which the pump mechanism was rotated by the electric motor;

direction sensing circuit for generating actual rotation direction information; and logic circuit for comparing the actual rotation direction information with the information about the last direction in which the pump mechanism was rotated by the electric motor and for actuating the indicator device in the event of a disagreement between the actual rotation direction information and the information about the last direction in which the pump mechanism was rotated by the electric motor.

17. The apparatus of claim 16 wherein the independent source of electrical power comprises a battery.

18. The apparatus of claim 16 wherein the engaging circuit further engages the reversal sensing circuit in the event of a unavailability of at least one component of the pump assembly.

19. The apparatus of claim 16 wherein the engaging circuit engages the direction sensing circuit with electric motor.

20. The apparatus of claim 16 wherein the engaging circuit engages the independent source of electrical power with the reversal sensing circuit.

21. The apparatus of claim 16 wherein the memory circuit stores information about a last commanded motor rotation direction.

22. The apparatus of claim 16 wherein the motor is a dc motor and the direction sensing circuit detects the polarity of back EMF generated by manual rotation of the electric motor, one polarity being indicative of the clockwise direction of rotation, the other being indicative of the counter-clockwise direction of rotation.

23. The apparatus of claim 16 wherein the logic circuit prevents the indicator device activating when the pump mechanism is stationary.

24. The apparatus of claim 1 wherein the indicator device is a piezoelectric audible signalling device.

25. The apparatus of claim 1 wherein:

the pump assembly is a peristaltic pump for use in a medical procedure having a rotor assembly for progressive occlusion of a flexible medical tube when the rotor assembly is rotated; and the device is adapted to permit a human pump operator to selectably manually drive the pump mechanism is a hand crank cooperatively interacting with the rotor assembly.

* * * * *